US006178914B1

(12) United States Patent
Axelsson

(10) Patent No.: US 6,178,914 B1
(45) Date of Patent: Jan. 30, 2001

(54) METHOD AND AN ARRANGEMENT FOR LAUNCHING AND TAKING ABOARD A RAFT

(75) Inventor: Sune Georg Axelsson, Bastuvägen 37, FIN-22100, Mariehamn (FI)

(73) Assignees: Sune Georg Axelsson; Folke Vidar Leonard Axelsson; Claes Arnold Ekstrom, all of Mariehamn (FI)

( * ) Notice: Under 35 U.S.C. 154(b), the term of this patent shall be extended for 0 days.

(21) Appl. No.: 09/125,015

(22) PCT Filed: Feb. 6, 1997

(86) PCT No.: PCT/FI97/00074

§ 371 Date: Dec. 4, 1998

§ 102(e) Date: Dec. 4, 1998

(87) PCT Pub. No.: WO97/29012

PCT Pub. Date: Aug. 14, 1997

(30) Foreign Application Priority Data

Feb. 7, 1996 (FI) ..... 960564

(51) Int. Cl.[7] ..... B63B 23/02

(52) U.S. Cl. ..... 114/368; 114/253; 114/242; 114/248

(58) Field of Search ..... 114/343, 364, 114/221 R, 230.1, 231, 150, 144 R, 253, 258, 259, 365, 375, 368, 378, 379, 242, 246; 280/508

(56) References Cited

U.S. PATENT DOCUMENTS 2,113,338 * 4/1938 Wohldorf ..... 280/508
2,398,274 * 4/1946 Albert ..... 114/259
3,448,712 * 6/1969 Lehmann et al. ..... 114/259
4,275,677 * 6/1981 Nelson ..... 114/246

FOREIGN PATENT DOCUMENTS 2 092 101A 8/1982 (GB) .
2279045 * 12/1994 (GB) ..... 114/259
89234 5/1957 (NO) .
506 365 12/1997 (SE) .

* cited by examiner

*Primary Examiner*—Ed Swinehart
(74) *Attorney, Agent, or Firm*—Arent Fox Kintner Plotkin & Kahn PLLC

(57) ABSTRACT

The invention relates to a method for launching and taking aboard a floating device (6) at a ship (1) under way. Said floating device (6) is arranged in and connected to a cradle (4) which is floating as such and open at the back. Said cradle hangs in a flexible carrying means (10) and is launched using a hoisting means (11) arranged at said ship (1). The bow portion (14) of said cradle (4) is guided using a flexible separate towing means (15) in such a manner that said cradle (4) when it floats on the water (2) will be directed in the ship's (1) general travelling direction. When said floating device (6) is not connected to said cradle (4) it is able freely to move into said cradle (4) and out therefrom through its stern portion (8). The invention also relates to a means for launching and, respectively, taking aboard a floating device (6). Said means comprises an essentially U-shaped cradle (4) which is floating as such and having a space (7) which is open in a direction away from said ship, said space being adapted for receiving said floating device (6). The invention further relates to appropriate locking and steering means for said cradle (4).

19 Claims, 3 Drawing Sheets

METHOD AND AN ARRANGEMENT FOR LAUNCHING AND TAKING ABOARD A RAFT

BACKGROUND OF THE INVENTION

1. Field of the Invention

The present invention relates to a method and to an arrangement in accordance with the introductory portion of the appended claims. Especially, the invention relates to a method for launching and, respectively, taking aboard an independent floating object at the bow, side or stern of a ship or other transporting means in motion, or at any other arrangement which has a relative movement with respect to a surrounding medium. The present invention also relates to a device for use as a working platform at sea and especially for launching and, respectively, taking aboard a floating device at a ship or other transporting device, as well as to a steering device for a towed device and to a locking device for locking a floating device to a cradle arranged for said floating device.

2. Description of the Related Art

Since a long time prior art knows different davit arrangements for launching, in an emergency situation and otherwise, smaller boats and other floating devices. Known davit arrangements comprise beam means which usually can be turned or folded out over a ship's bulwark, and hoisting means for lowering and, in certain situations, also hoisting up floating devices like life boats, life saving rafts and the like. Arrangements are also known for launching such floating devices using special ramps without the use of davits, in which case one uses slides instead. In the latter arrangement very grave difficulties usually are included with any rehoisting of the floating device, and said devices are mostly intended for rescuing the ship's own crew.

Known davit arrangements have the drawback that launching and taking aboard a floating device in bad weather and at high waves is combined with very high risks. On the other hand, such circumstances often are at hand especially in those situations when a rescue vessel or the like floating device must be launched to perform a life saving operation. In known davit and the like arrangements a smaller floating device will be suspended directly in its hoisting means and in rough sea two mutually independent pairs of power will act upon the floating device. When said floating device is suspended in its hoisting means said means are fully stressed, while, on the other hand, when a wave hits the floating device said device often will be fully floating in slack hoisting means. In this position said hoisting means should be disconnected from the floating device, and, respectively, be connected to the floating device when it shall be hoisted on board again. It is clear that such an arrangement is especially unsuitable for hoisting and taking aboard a floating device in rough sea. In practice one will aim at turning the ship so that the work can be done in some kind of lee, but this is in no case possible in all situations, and thus one cannot in all conditions guarantee more than the launching. In rescue operations, on the other hand, the taking aboard of the rescued and the own personnel is of a decisive importance.

The international convention "Solas" (Safety of Life at Sea) will propose additional demands stating that a fast rescue boat must be on board all roll-on-roll-off passenger ships. Said fast rescue boat (FRB) must be quickly launchable from the mother ship on the move also during hard weather conditions and it must also be quickly hoistable back on board. This sets quite special demands on the equipment for launching and recovering on-board. One cannot see the possibility, using known hoisting means having a hoisting hook, to take aboard a rescue boat in the size of about 6 to 8 meters in a situation where the wave height is several meters. A boat of that size will vertically follow the wave, and an unhooking and hooking to e.g. a crane is under such circumstances difficult, dangerous and perhaps impossible.

SUMMARY OF THE INVENTION

The purpose of the present invention is to solve those practical problems which the new convention will bring about, and simultaneously to give, also for other situations, a versatile and useful solution to the problem of launching and taking aboard a floating device. The invention further indicates a method for drastically improving the capacity of a free operating rescue boat where rescued persons in an easy and secure manner can be quickly taken care of on a device which during towing can act as an intermediate and working platform and as a hoisting arrangement, where the rescue boat may continue its functions. The invention also shows a practical solution on problems related to taking aboard a pilot, diving and surveying operations; unloading during run as well as other civilian and military operations.

The invention is characterized as indicated in the appended claims. Thus, the method is characterized by arranging and detachably connecting a floating device to be launched or, respectively, taken aboard in a generally open cradle, said cradle being, as such, floating as well as open in a direction away from the ship. The entity comprising said cradle and the floating device connected thereto is launched and, respectively, taken aboard suspended from a flexible carrying means using a preferably extendable hoisting device arranged at said ship while the guiding of the cradle's bow portion which is directed towards said ship is performed using a flexible separately-arranged towing means in such a manner that said cradle, when it floats on the water surface preferably behind said ship, will be generally directed in the ship's direction of movement. When the floating device is not connected to said cradle, i.e. when said cradle is not in the air, said floating device is able to essentially freely move into the floating cradle as well as out thereof through said cradle's open stern portion which is directed away from said ship.

The apparatus according to the invention is characterized in that said apparatus comprises an essentially U-shaped cradle, which as such is floating, said cradle having a space for receiving said floating device, said space being essentially open in a direction away from said ship, hoisting means for hoisting up and, respectively, lowering said cradle in relation to a water surface, as well as guiding means for guiding, through a towing pulling action, said cradle into a desired position in relation to said ship's direction of travel. Preferably said cradle comprises a special steering means in accordance with the invention, said means being characterized in that said steering means comprise an attachment point for a towing means, said attachment point being arranged at a first steering yoke which is pivotably attached to the towed device, at least one end of said steering yoke being arranged for moving, upon a turning of said yoke, a piston in a first cylinder, said device further comprising tubes arranged between said first cylinder and a second cylinder for transporting a fluid between said first and said second cylinders, said second cylinder being connected to a second steering yoke adapted for turning actual steering means which are arranged at said towed device at a distance from said attachment point for said towing means.

The connecting of said floating device to said cradle will suitably be effected using the special locking device according to the invention, said device being characterized in that it comprises an open annular housing covering an arc of about 270° as well as two arched locking pins, which are movable in said housing away from each other in the direction of said arc against a spring force, at which locking pins operating means are arranged for arcuate moving said locking pins in said housing under force impact, where opposite front portions of said locking pins are inclined so that said inclinations form a V which is directed away from the center of said annular housing.

BRIEF DESCRIPTION OF THE DRAWINGS

The invention will now be described in more detail with reference to the appended principal drawings, wherein.

DETAILED DESCRIPTION OF THE PREFERRED EMBODIMENTS

Figure 1:
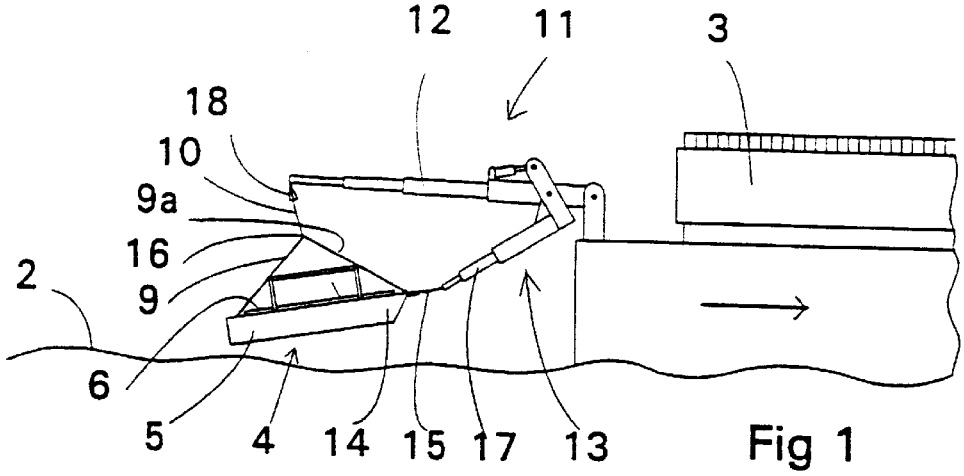
FIG. 1 shows the stern portion of a ship, where a cradle carrying a boat is lowered or hoisted up in accordance with one embodiment of the invention, said cradle being positioned in the air.
Figure 2:
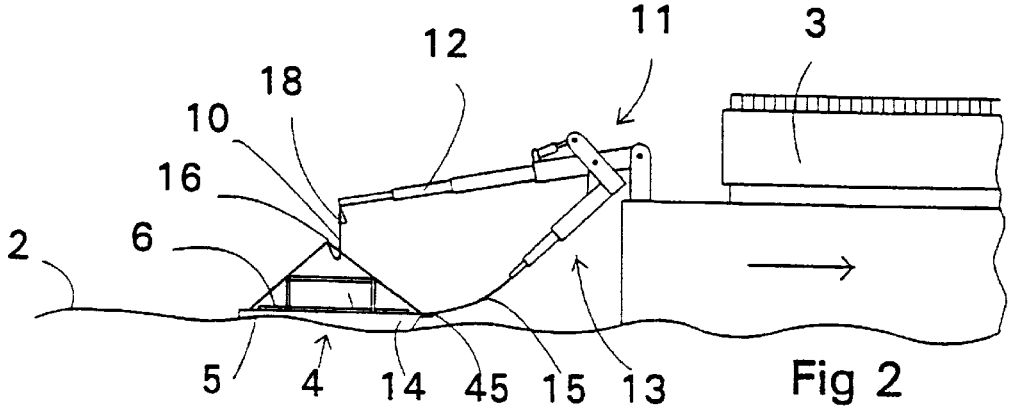
FIG. 2 shows the arrangement according to FIG. 1 in a position where said cradle lies on the water surface and said floating device is connected to said cradle either in order to be hoisted up or immediately after getting into contact with the water surface at the launching procedure.
Figure 3:
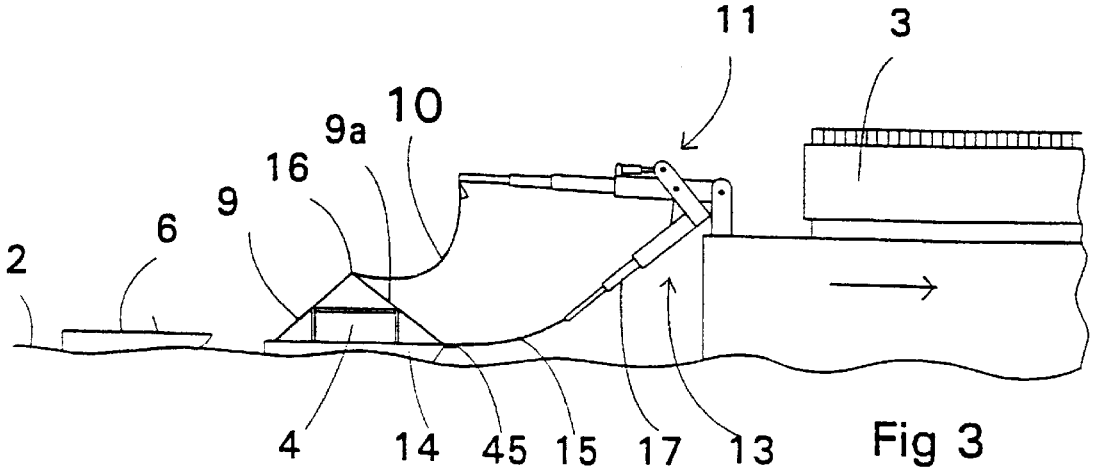
FIG. 3 shows the embodiment according to FIG. 1 when said cradle floats behind said ship and said floating device, in the shown case a rescue boat, is free behind the cradle, FIG. 4 from above shows a cradle in accordance with a favorable embodiment of the invention, FIG. 5 from the side shows a sectional view of the embodiment according to FIG. 4, FIG. 6 seen from the front and partially in section shows the embodiment according to claim 4, FIG. 7 generally shows a favorable connecting arrangement according to the invention, and FIG. 8 in a sectional view shows the arrangement according to FIG. 6.

The invention's functional solution in principle is generally evident from FIGS. 1, 2 and 3. According to the invention a mother ship 1 moves forwards at steering speed. Even at higher sea the interaction between the deplacement of said shin 1, the bow and stern waves and the propeller stream provides behind the ship an area having proportionally calmer water 2 which preferably can be utilized for launching operations, provided that the action takes place at some distance from the shin's stern 3 and the strongest propeller stream.

The arrangement according to the invention comprises suitably a catamaran like cradle 4 made of aluminum or any other appropriate material, between floating bodies or pontoons 5 of which a space is arranged and especially adapted for receiving the floating device 6, e.g. a rescue boat, which is to be used. Said floating device 6 may be a rescue boat of a standard type or the like, and said cradle is adapted in accordance with the floating device's individual design so that said floating device 6 will be kept, when the arrangement is not in the water, steadily in the essentially open inner space 7 of said cradle 4 between said pontoons 5, while said floating device 6 freely can move backwards and out of said cradle 4 through its essentially open stern portion 8, when said floating device 6 and said cradle 4 float on the water surface 2.

Normally the cradle 4 and the floating device 6 are inter-connected and stowed together at the ship's stern deck, suitably on a special bed made for that purpose. The cradle 4 suitably comprises special lifting means 9, 9*a* one of which 9*a* suitably operates at the bow portion of the cradle and two others suitably at the stern portion of each respective catamaran pontoon 5. The arrangement is stowed on the deck of the mother ship 1 in such a manner that said lifting means 9, 9*a*, i.e. stainless steel wires or the like are continuously though preferably detachably connected to a flexible carrying means 10 which also usually is a steel wire, a hoisting band or the like. Said carrying means 10 in turn is part of a hoisting device 11, suitably a special crane having a telescopically extendable boom 12. In this manner the whole arrangement continuously is functional at shortest possible warning. Even though here is proposed especially equipped hoisting and guiding means it should be observed that in certain cases also a standard deck crane can be used as said hoisting device 11, while the winch to be more closely discussed below may be a separate winch of standard type. The arrangement according to the invention is suitably located in the stern 3 of said shin 1 close to the center line, but in certain cases the arrangement may also be located at some other location, possibly even in the bow.

At the launch only the hoisting means 11 is activated and the arrangement carries essentially the cradle's 4 and floating device's 6 total weight. Using a winch means 13 the front portion 14 of the cradle 4 is guided with the aid of a towing steering means 15 attached to said front portion 14. Said steering means 15, e.g. a steel wire, is kept suitably loosely though still so stretched that the launch of the cradle 4 can be secured to essentially the general moving direction of the mother ship 1 and so that any swaying due to sea and wind can be damped. Preferably said carrying means 10 will extend slightly inclined with respect to the vertical direction (see FIG. 1) and it connects to the cradle 4 in an attachment point 16 located above the same. With respect to the stability it is usually suitable that said lifting means 9, 9*a* extend at an angle of about 30° with respect to the vertical axis. In certain cases it is appropriate to separately guide one or several lifting means 9, 9*a* using a guiding wire 9*b* extending between said respective lifting means and a suitable point on the cradle 4.

Said winch means 13 preferably comprise an extendable boom 17 and they are suitably functionally connected in an interacting manner with said hoisting means 11. By making said boom 17 of said winch means extendable and, according to one embodiment, also laterally turnable, the point of towing can be controlled and on demand be lowered to a low position, which is appropriate with respect to stability. When the hoisting means 11 during the launch have lowered the cradle 4 and the thereto connected floating device 6 so far down that they will float on their own, the angle of the carrying means 10 is changed in relation to said boom 12 of said hoisting means 11. A detecting device 18 is suitably arranged at the outer end of said boom 12, and the change of angle for the carrying means 10 gives through said detecting device 18 a signal indicating that the cradle 4 and the floating device 6 are floating (see FIG. 2). At this stage the hoisting mean's functions are disconnected and the winch 13 for the towing steering means 15 is activated. This switching is preferably effected using hydraulic means which in turn suitably are controlled by a microprocessor.

Preferably, said detector 18 is arranged so that it surrounds the carrying means 10. In order to optimize the security said detector 18 suitably comprises three different functional positions, where a forward angular position indicates that the carrying means 10 extends forwards in too wide an angle so that the cradle 4 and the floating device 6, when they reach the water surface, would break therethrough and in worst case perhaps even be filled with water. In this position the operation suitably should be interrupted and a warning signal be given. The angle between this forward alarm position and a middle angular position indicates a working range where a secure lowering is possible. Normally this working range will lie, seen in the travel direction of the ship, some degrees of angle forwards from the vertical line through the point where the carrying means engages to said boom 12. A third angular position which lies, seen in the travel direction, behind said working range although normally also this position is located forwards from said vertical line, and extends possibly also in the sidewards direction, indicates that the carrying wire 10 does not any more carry the cradle 4 essentially vertically but slightly afore the vertical line, i.e. that the cradle is afloat on its own. In this position the carrying means 10 should be kept slightly loose in order to prevent the cradle 4 from overturning due to any pulling at the carrying means 10. If the detector means 18 from the angle indication cannot verify that the carrying means 10 has been given a necessary slack, the detector 18 suitably governs the interruption of the operation and an alarm is given.

In the next step the towing steering means 15 let the cradle 4 withdraw farther astern and away from the strongest propeller stream. The cradle 4 is not any more under the influence of any force from the carrying means 10 which, although slacked still continuously remain connected to the cradle's 4 lifting means 9, 9*a*. Instead, the towing steering means 15 keep the cradle at a proper distance from the ship 1 (see FIG. 3). According to a favorable embodiment the lifting means 9, 9*a* and/or the carrying means 10 are guided away by suitably flexible arches or the like supports so that said means 9, 9*a*, 10 do not disturb the actual operation.

At this stage said cradle 4 acts as a floating docking device for the floating device 6. When the locking between the cradle 4 and the floating device 6 has been opened the floating device 6 is able to freely reverse out from the cradle 4 through the open portion 8 at the cradle's 4 stern or, respectively, steer into the space 7 between the cradle's 4 pontoons 5 and if needed connect to the cradle 4 which continuously remains in the general traveling direction of the mother ship 1 and travels with equal speed. At this stage the floating device 6, e.g. a rescue boat is able to perform an arbitrary number of rescue operations using the cradle 4 as its base. If necessary the cradle 4 can e.g. be provided with spacings for rescued persons, and the cradle can also be hoisted aboard at any time. According to a preferred embodiment for small rescue boats having a size usual in the mercantile shipping, the cradle 4 in practice will comprise a deck of about 20 $m^2$ which can be used by persons assisting in the rescue operation as well as for keeping rescued persons, for which a fairing suitably is arranged over at least a portion of the deck.

It might also be appropriate to provide the cradle 4 e.g. with a fuel supply for one or several rescue or other working boats. When the rescue operation is ended the rescue boat 6 will again dock into the cradle 4. The cradle 4 will follow the rescue boat's movements also in heavy sea, which facilitates that a secure docking procedure and with a minimal risk for the personnel can be performed also under difficult conditions.

When the connection between the floating device 6 and the cradle 4 has been locked the entity so established can again be hoisted aboard in the opposite order with respect to the launch. Since the cradle 4 all the time is connected both to the towing steering means 15 and to the carrying means 10 one does not need to perform any kind of operations and connections between freely suspended hoisting means and floating devices moving at the rate of the heave of the sea.

Figure 4:
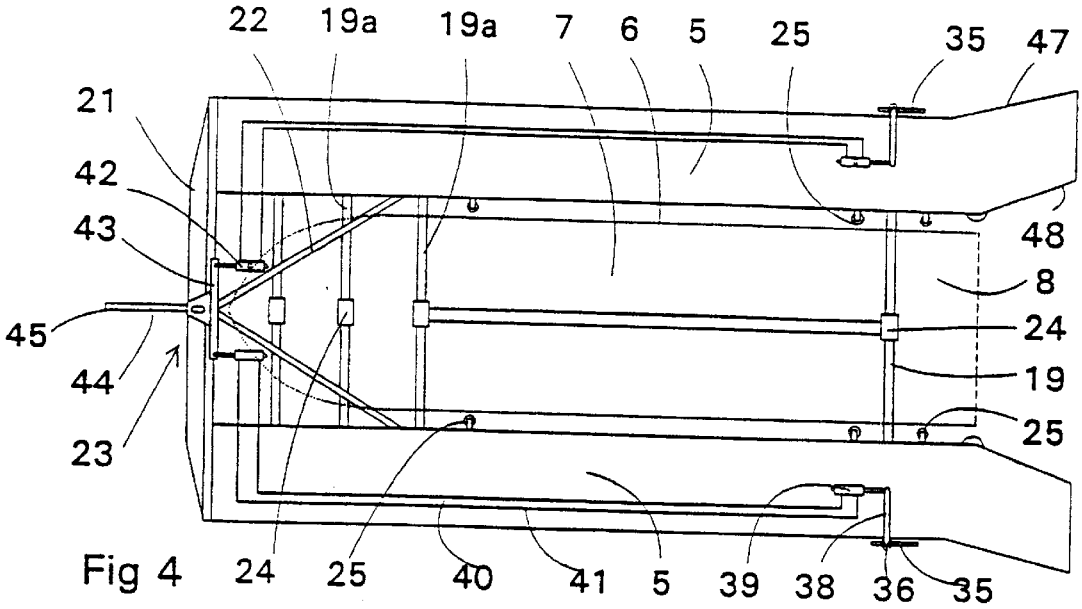
Figure 5:
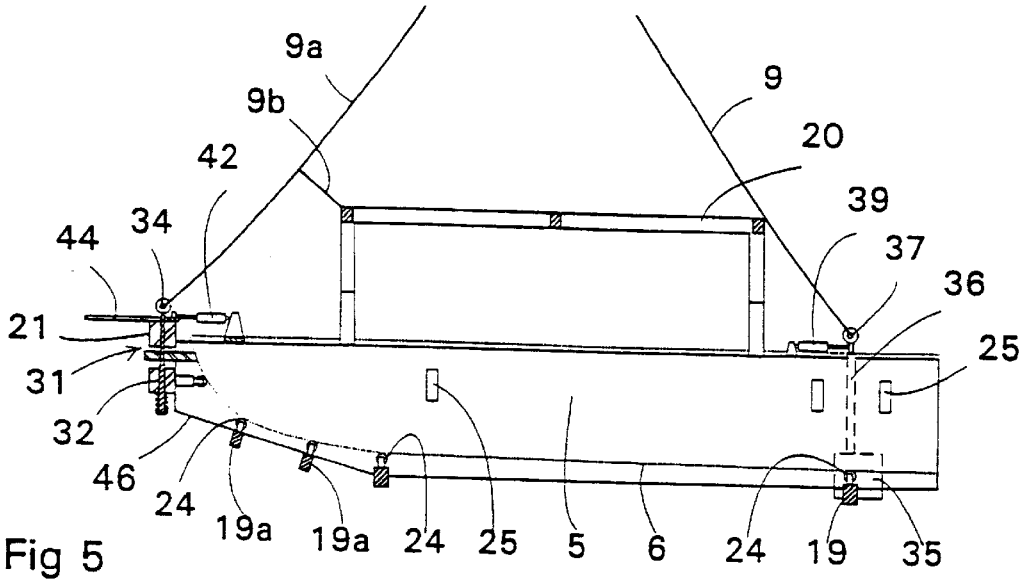
Figure 6:
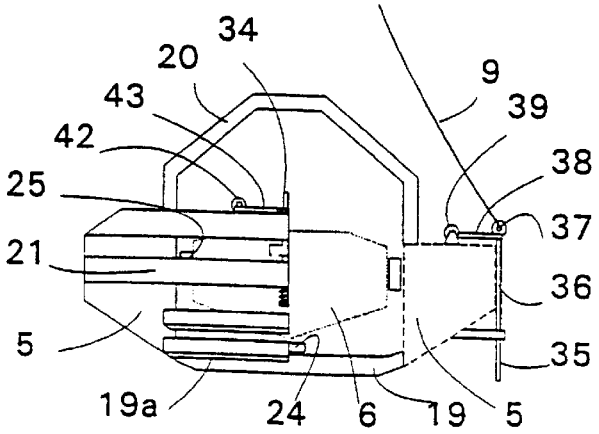

In the embodiments according to FIGS. 4, 5 and 6 said cradle 4 suitably comprises two suitably sectioned pontoons 5 arranged in an essentially parallel manner and preferably permanently interconnected by transverse beams 19, 19*a*, 19*b*. At least some 19*a*, 19*b* of said transverse beams have a double mission in that they act both as interconnecting elements and simultaneously act as damping devices which slightly retard the cradle's 4 speed. Therethrough is achieved, on one hand, a continuous positive pull in the towing steering means which improves the steering properties. On the other hand, the retardation against the water facilitates the docking of the floating device 6 since the cradle 4 does not slip away.

According to a favorable embodiment of the invention at least some of the front transverse beams are provided with a front plate 46 or the like which further retards the movements of the cradle 4 and reduces the seaway therewithin. In the embodiment disclosed in FIG. 6 the pontoons 5 are also in the upper portion interconnected by arcuate beams 20 which suitably constitute the framework for said fairing or the like. In the proposed embodiment a pair of stronger transverse beams 21 are arranged in the front portion of the cradle 4 and a pair of cross beams 22 give a torsion resistance and simultaneously a guidance so that the floating device 6 will hit a locking device 23 which suitably is arranged at the central line of the cradle 4 between said beams 21.

The cradle 4 is dimensioned in such a manner that it will float of its own and have such a draft that the floating device 6 freely can float into the space 7 between the pontoons 5 about halfway into the cradle 4. The beams 19*a* are on suitable locations provided with keel rolls 24 which preferably are arranged in such a manner that the floating device 6 using its own engine power presses the keel against said rolls 24 and then obtains an aft trim and adjoins all said rolls 24 and a locking device generally indicated with the reference 23 situated between the cradle 4 and the floating device 6. In this position side rolls 25 give support from the side.

Figure 7:
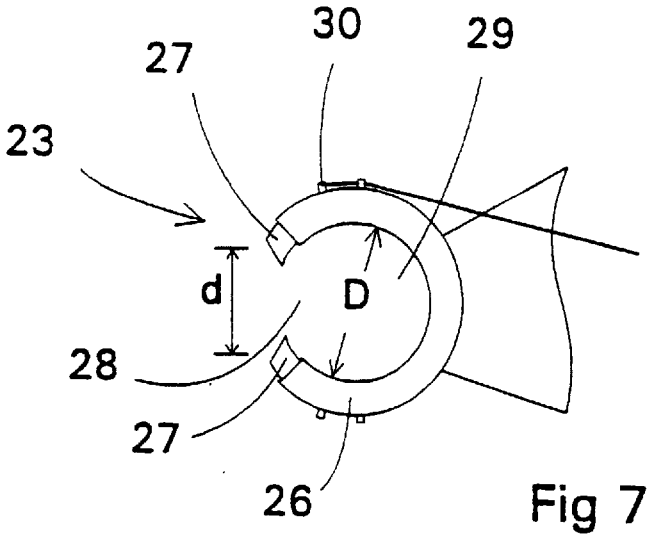

For security reasons its is most important that the coupling between the floating device 6 and the cradle is arranged in such a manner that it is impossible to open the connection when the arrangement is in the air and suspended in the carrying means 10. Thus, in FIG. 7 is shown a favorable locking device according to one embodiment of the invention. The locking device 23 is suitably attached to the bow portion of the floating device and comprises a housing 26 having a circular arcuate shape wherein two locking tongues 27 run. Said housing 26 covers an arc of about 250° to 280° and said tongues 27 are able to move into said housing 26 against the force of a spring (not shown) arranged therein so that there will appear a free opening 28 in the locking device for the introduction of a suitably round counter piece into the open portion 29 of the locking device.

When said locking tongues 27 are positioned in their protruding position this opening will be closed to such an extent that the round counter piece cannot pass therethrough. In order to facilitate an automatic function, the front portions of said locking tongues 27 are suitable beveled in such a manner that their front surfaces between themselves constitute an open V. When said round counter piece is pressed against the locking tongues 27 they are pushed into the housing 26 and the counter piece can pass into the area surrounded by the housing 26. A passage in the opposite direction is, on the other hand, impossible unless the locking tongues 27 are mechanically opened against said spring force, e.g. using handles 30 connected to a pulling wire.

In order to automatically secure, in connection with the cradle 4, the function of the locking mechanism 23 in accordance with the invention so that the lock cannot be opened when the floating device 6 is in the air, it is appropriate to design said lock in such a manner that the distance between said locking tongues 27 in their open position corresponds to the smaller diameter "d" of an upper portion 31 of a vertical spindle pin 32 which is located in the front end of the cradle 4, while a lower portion 33 suitably arranged under a conical portion of said spindle pin has a greater diameter "D". This greater diameter "D" corresponds, within a suitable tolerance, to the largest inner diameter of the open portion 29 of said housing 26.

In the cradle 4 said spindle pin 32 is arranged movably in the vertical direction and spring loaded in the downwards direction with a spring force which suitably corresponds to about half the force considered to be needed to hoist the cradle 4. In this position the portion having the smaller axial diameter "d" will be located at the level of the locking device 23 in the floating device's 6 bow portion 14, and so the spindle pin 32 is able to pass into the lock's open portion 29 through said opening 28 between the locking tongues 27. The one of the lifting means 9*a* which acts at the cradle's bow portion 14 is connected to the upper end 34 of said spindle pin 32, and when the cradle 4 is hoisted said spindle pin 32 will be pulled slightly upwards and then the lower portion 33 of said spindle pin 32 having the greater diameter "D" will be pressed up into the open central portion 29 of said lock housing 26. The locking device 23 will in turn suitably rest against one of the cradle's 4 front beams 21, and in this position it will be impossible for the spindle pin 32 to pass through said opening 28 even if the locking tongues 27 would be accidentally opened.

Figure 8:
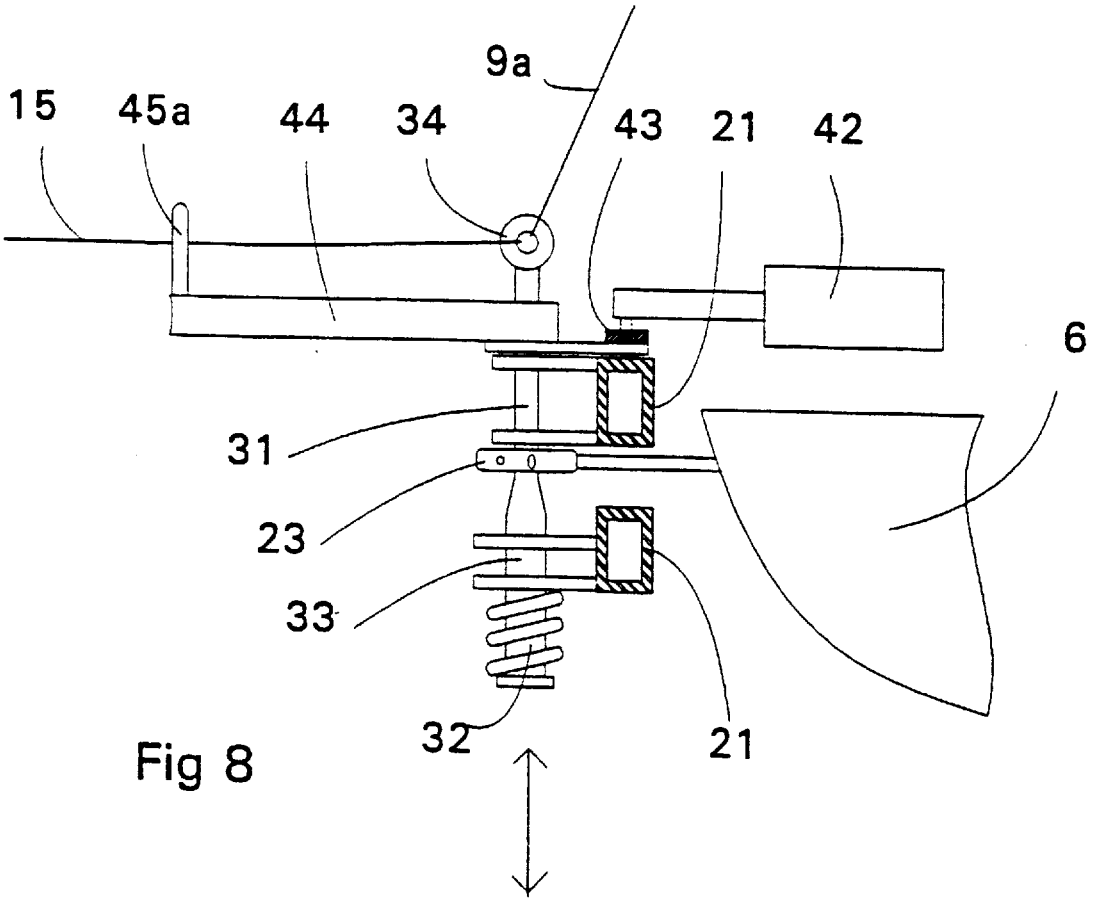

In order to keep the cradle 4 always in a correct position with respect to the mother ship 1 it is suitably provided with special steering means in accordance with FIGS. 4, 5 and 8. Principally the inventive steering means comprises one or several rudder blades 35 which suitably are arranged at the stern of each respective pontoon 5. Each rudder blade 35 is arranged at a shaft 36 which is pivotably arranged using a thrust bearing and the upper part of which suitably comprises an attachment point 37 for a respective lifting means 9. The upper end of the respective shaft 36 comprises a rudder yoke 38 which in turn suitably is connected to a power means, in the disclosed embodiment to a hydraulic cylinder 39.

In accordance with FIG. 4 the respective hydraulic cylinder 39 is connected through double tube lines 40, 41 to a corresponding respective hydraulic cylinder 42, the piston of which in turn is connected to a respective end of a centrally journalled transversal beam 43. In the embodiment shown in FIGS. 4, 5, 6 and 8 said transversal beam 43 is suitably journalled to the spindle pin 32 of the locking device 23 which has been described earlier. A short pulling beam or a steering yoke is suitably attached to said transversal beam 43 in a perpendicular but vertically movable manner.

According to a preferred embodiment of the invention the towing steering means 15 is connected to or via the outer end 45, 45*a* of said steering yoke 44. A skew pulling force at the towing steering means 15 will turn the steering yoke 44 which simultaneously tends to turn the transversal beam 43 into the direction of the pulling force. The torque will press one of the hydraulic cylinder's 42 pistons backwards and pull the corresponding piston of the other cylinder forwards. The movement at the respective pistons will bring about a stream of fluid in the respective tubings 40, 41 in such a way that also the pistons in the respective hydraulic cylinders will move, whereupon the respective rudder yoke 38 will turn in the opposite direction with respect to the steering yoke 44. At the same time the rudder blades 35 will turn into a direction which parries the skew pulling force at the steering yoke 44. In this manner the cradle 4 will automatically endeavour to follow the mother ship 1 straight also on such occasions when side wind and waves endeavour to move the cradle 4 sideways. The relations between said hydraulic cylinders are suitably chosen in such a manner that the transmission ratio at the rudders will be about 2:1 which in a towing situation gives a quicker response to diversions in the heading. In certain cases the hydraulic arrangement can be replaced with an electric, a mechanic or an arrangement based on wires, but a closed hydraulic system has the advantage of high operational reliability and a minimum of maintenance.

In the embodiment according to FIG. 4 the cradle's pontoons 5 at respective stern ends comprise a portion 47 which is turned slightly outwards, suitably about 20° with respect to the longitudinal axis of the cradle 4. The outwardly bent portion in the stern of the cradle 4 will slightly retard the forward movement of the stern and gives thereby a momentum which stabilizes the heading. Simultaneously the cradle's 4 pontoons 5 suitably comprise a corresponding outwards bent portions 48 also at those sides of the cradle 4 which are directed towards the inner space 7 of the cradle 4 so that said open space 7 at least in the portion located most aft in practice will be at least slightly wedge-like which facilitates the access of the floating device 6 especially in rough weather conditions.

Above some preferred embodiments of the invention have been described but for the professional it will be clear that the invention can be varied in many ways within the scope of the appended claims. It will also be evident that the solutions given above can be used also in other contexts than those indicated above. Thus, the arrangement according to the invention can be used for different kinds of rescue and working boats or the like and also directly as a working platform at sea. Although the arrangement according to the invention above has been described with reference to an embodiment which is adapted for use with a ship it is evident for the expert that the same arrangement with certain modifications also can be used e.g. for launching and, respectively, hoisting up corresponding floating devices from e.g. a huge helicopter. In certain special cases, e.g. in connection with airborne launching it might be appropriate to provide the cradle with a motor and propeller means of its own which gives the cradle a certain mobility and steerability. In certain cases such means can suitably be used in order to stabilize the cradle 4 also when the mother ship 1 does not have steerage way or e.g. for independent steering of the cradle from one side of a ship to the other. It is also evident that the same solution principle can be utilized in embodiments where one or several flexible carrying and steering means are replaced with more rigid constructions like permanent beams or the like which extend outwards from the ship.

The locking arrangement according to the invention can be used also in other applications where during a hoisting of interconnected objects a secure locking is demanded. The steering arrangement according to the invention can also be used when the intention is to tow or in some other way bring an object to move, under difficult conditions, in relation to a fluid.

What is claimed is:

1. A method for launching and retrieving a floating craft from a vessel, said method comprising the steps of:

providing a hoisting means attached to a vessel;

providing a floating means attached to said hoisting means by a carrying device, said floating means having a rigidly defined shape being configured to be raised and lowered by the hoisting means acting on the carrying device;

providing a floating craft which is configured to be engaged in said floating means when said floating means is in a suspended state and which is configured to float freely within said floating means when said floating means is floating on a water surface;

providing a towing means attaching a first end of said floating means to the vessel;

floating said floating means on the water surface wherein an end of said floating means toward said vessel is loosely tethered toward said vessel by the towing means, and wherein the carrying device slackly connects the floating means to the hoisting means wherein the floating craft freely floats within a receiving area of the floating means.

2. A method as recited in claim 1, further comprising the steps of:

providing a lifting means on said floating means, said lifting means attaching to at least two points on said floating means and providing a centrally located point for attaching said carrying device to said hoisting means;

providing a winch on said vessel;

providing an attachment device on the first end of the floating means;

attaching said towing means from said winch to said attachment device; and controlling a position of the floating means by selectively controlling the hoisting means and the winch.

3. A method as recited in claim 2, further comprising the steps of:

inclining the floating means during hoisting and lowering operations, when said floating craft is secured to said floating means, said inclining step being performed by controlling an angle of the floating means with the winch and the hoisting means.

4. A method as recited in claim 2, comprising a step of, during hoisting and lifting operations, maintaining a normal floating attitude of said floating means by maintaining a slack in the carrying means with the hoisting means, and controlling a distance of said floating means from said vessel by controlling the winch.

5. A system for launching and hoisting a floating craft from a vessel, said system comprising:

floating means for receiving a floating craft therein, said floating means comprising a rigidly defined substantially U-shaped floating frame with an open end of said U-shaped floating frame being configured to be open in a direction away from the vessel, said U-shaped floating frame defining a receiving area for receiving the floating craft therein;

a hoisting device attached to said floating means by a carrying device for lifting and lowering said floating means from the vessel to and from a surface of water;

a towing device attached to a first end of said floating means and adapted to be attached to said vessel for orienting the floating means such that the open end of the substantial U-shaped frame is open in the direction away from the vessel.

6. A system as recited in claim 5, wherein said substantially U-shaped floating frame comprises a frame structure having a floating body on each side of the defined receiving area, and a plurality of transverse beams connecting the floating bodies and for guiding the floating craft into the receiving area, wherein distal ends of the floating bodies which are disposed at the open-end of the substantial U-shape diverge away from the open area to assist in guiding the floating craft into and out of the receiving area.

7. A system as recited in claim 5, further comprising a fastening device providing a single central fastening point for attaching said floating means to the carrying device, said fastening means including at least one lifting member secured to a plurality of mounting points on said frame, said plurality of cables connected to said carrying device at a single fastening point.

8. A system as recited in claim 7, further comprising steering means mounted on said frame and connected to at least one of said plurality of mounting points, said steering means for steering said floating means.

9. A system as recited in claim 5, further comprising locking means for locking said floating craft to said floating means.

10. A system as recited in claim 5, further comprising a detecting means connected to said hoisting device, said detecting means for detecting slack in the carrying device and for controlling movement of the hoisting device and the towing device.

11. A system as recited in claim 10, wherein said towing device comprises a winch adapted to be mounted on said vessel for controlling movement of a towing member, and wherein said detecting means further comprises a microprocessor connected to said winch and said hoisting device for controlling an attitude of the floating means by controlling the hoisting device and the winch.

12. A system as recited in claim 8, said steering means further comprises a steering element disposed toward a distal end of each of said floating bodies, each said steering element being connected to a steering yoke assembly attached to said towing device, said steering yoke assembly translating movement thereof into respective movement of said steering elements.

13. A system as recited in claim 12, wherein said steering yoke assembly comprises a first steering yoke attached to said towing device and a second steering yoke attached to at least one of said steering elements, said first and second steering yokes being attached to corresponding pistons and cylinders for respectively actuating said at least one of said steering elements.

14. A system as recited in claim 5, further comprising a locking means for locking the floating craft to the floating means, said locking means comprising an annular housing adapted to be attached to said floating craft with an open portion therein, said annular housing including two arcuate locking pins movable within a portion of said annular housing to open and close the open portion of the annular housing, said locking pins being biased by a biasing means toward each other, said locking means further including operating means attached to the locking pins for moving the locking pins away from each other to open the open portion of the annular housing.

15. A system as recited in claim 14, wherein a front face of each of said locking pins is shaped such that the pair of locking pins forms an open V diverging away from a center of the annular housing, wherein a force impact on a surface of the open V results in movement of at least one of the locking pins against a force of the biasing means.

16. A system as recited in claim 15, said locking device further comprising a spindle pin on said floating means configured to engage said open annular housing, said spindle pin comprising a first portion having a first diameter and a second portion having a second diameter which is greater than said first diameter, said spindle pin being longitudinally movable such that when the second portion is disposed within said annular housing, the annular housing can be disengaged from the spindle pin by opening the locking pins, and when the second portion is disposed within the annular housing then disengagement cannot occur.

17. A steering system for a towed floating device, said steering system comprising:

an attachment element adapted to be attached to the towed device for attaching a flexible towing means thereto;

a first steering yoke attached to said attachment element, said first steering yoke being coupled to a first piston, a first cylinder, and tubing;

a steering element attached to said towed device;

a second steering yoke attached to said steering element, said second steering yoke including a second piston and a second cylinder, said second piston and second cylinder being connected to said tubing, wherein lateral movement of said attachment element is translated into movement of said first and second steering yokes and subsequent movement of said steering element through the pistons, cylinders and tubing.

18. A system for securing a floating craft to a floating element, said system comprising:

an annular housing adapted to be attached to the floating craft, said annular housing including an open portion therein and two arcuate blocking pins movable within a portion of the annular housing to open and close the open portion, said locking pins being biased by a biasing means toward each other, and further including operating means attached to the locking pins for moving the locking means away from each other to open the open portion.

19. A system as recited in claim 18, wherein a front face of each of the locking pins is shaped such that the pair of locking pins forms and V diverging away from a center of the annular housing, wherein a force impact on a surface of the open V results in movement of at least one of the locking pins against a force of the biasing means.

* * * * *